United States Patent [19]

Nijman

[11] 4,180,904

[45] Jan. 1, 1980

[54] FIELD TERMINATION TOOL HAVING A REMOVABLE CONNECTOR MOUNTING MECHANISM AND AN INSERTION CONTROL MECHANISM

[75] Inventor: John P. Nijman, West Hill, Canada

[73] Assignee: Bunker Ramo Corporation, Oak Brook, Ill.

[21] Appl. No.: 768,578

[22] Filed: Feb. 14, 1977

Related U.S. Application Data

[62] Division of Ser. No. 580,577, May 27, 1975, Pat. No. 4,038,745.

[51] Int. Cl.[2] ..... H01R 43/04

[52] U.S. Cl. ..... 29/749; 29/566.3; 29/753

[58] Field of Search ..... 29/720, 749, 751, 753, 29/760, 566.3

[56] References Cited

U.S. PATENT DOCUMENTS

| | | | |
|---|---|---|---|
| 3,118,696 | 1/1964 | Resare | 29/453 |
| 3,229,029 | 1/1966 | Weiss | 29/453 |
| 3,845,535 | 11/1974 | Over | 29/749 X |
| 3,866,293 | 2/1975 | Nijman | 29/753 X |
| 3,952,392 | 4/1976 | Nijman et al. | 29/749 X |

*Primary Examiner*—Carl E. Hall

*Attorney, Agent, or Firm*—F. M. Arbuckle; Russell N. Muehleman

[57] ABSTRACT

A field termination tool for electrical connectors includes a connector support which is positioned between a pair of rotatably mounted insertion arms. Each of the insertion arms includes a multiblade insertion tool for engaging and pressing insulated conductors into respective insulation-piercing contact portions carried by a supported electrical connector. The connector support is constructed as a one-piece comb structure, preferably molded from glass-filled thermoplastic material with metal conductor cutting strips molded in, which is releasably engageable with the frame of the termination tool, and likewise releasably engageable with a bench-mounted support so that electrical connectors can be positioned in the comb structure and have the insulated conductors aligned with respective insulation-piercing contact portions at a point remote from the insertion tool. An insertion control mechanism takes two forms. A first form includes the provision of a ratchet on one insertion arm and a pawl on the other insertion arm which engages the ratchet and is prevented from disengagement therefrom until the arms have been moved toward each other to positions which constitute complete insertion of the conductors. A second form of control mechanism utilizes a pair of torque handles mounted on respective arms and each operable to generate a mechanical vibration or signal, e.g. an audible click, upon the application of a predetermined torque to each rotatable insertion arm. The attainment of the predetermined torque corresponds to complete conductor insertion.

11 Claims, 15 Drawing Figures

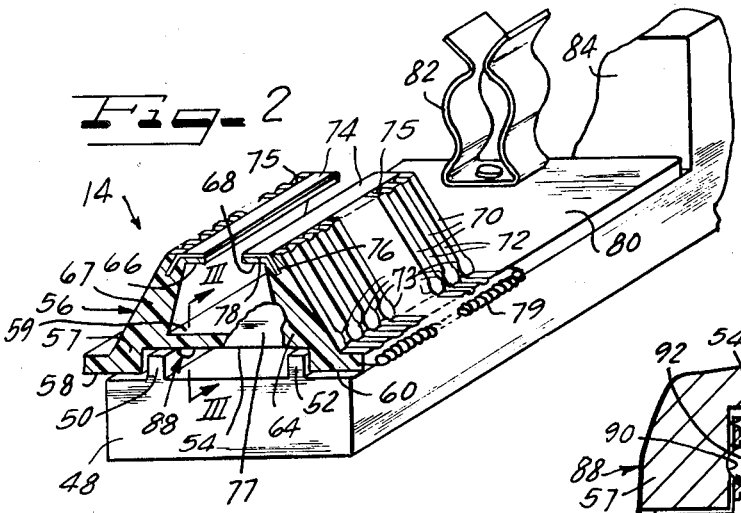
Fig. 2
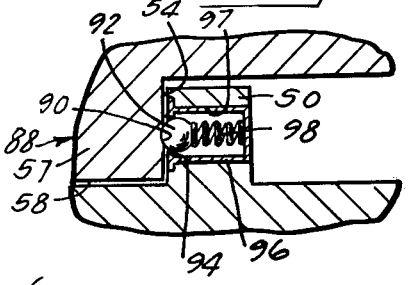
Fig. 3
Fig. 6
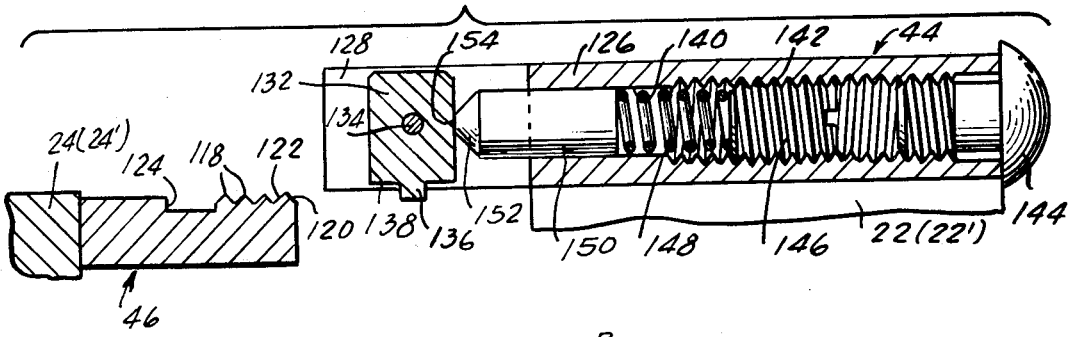
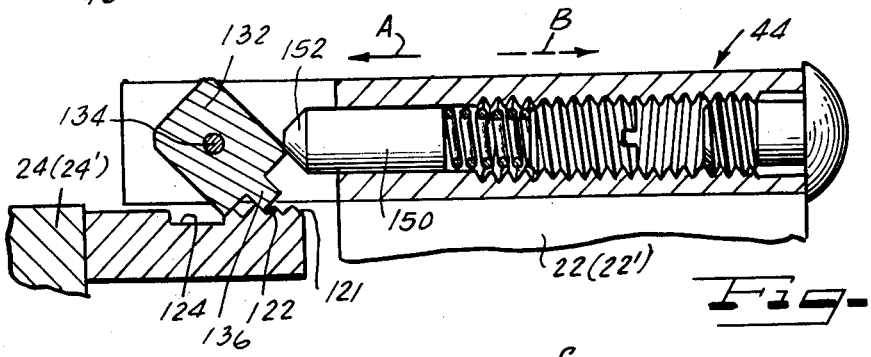
Fig. 7
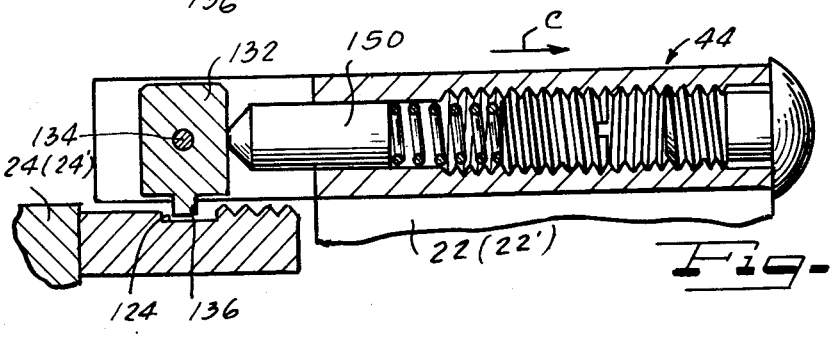
Fig. 8

Fig-4
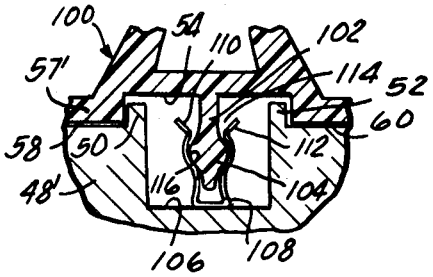
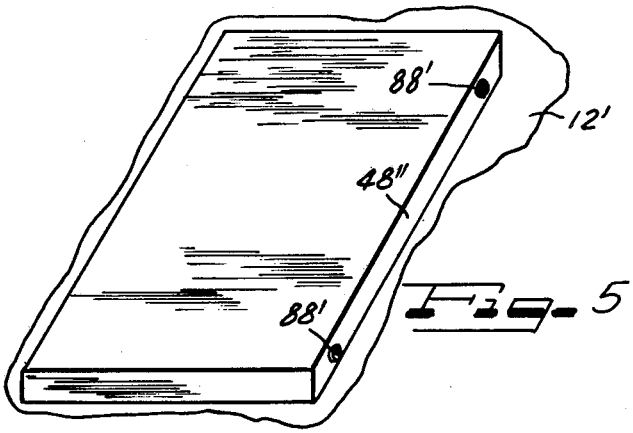
Fig-5
Fig-15
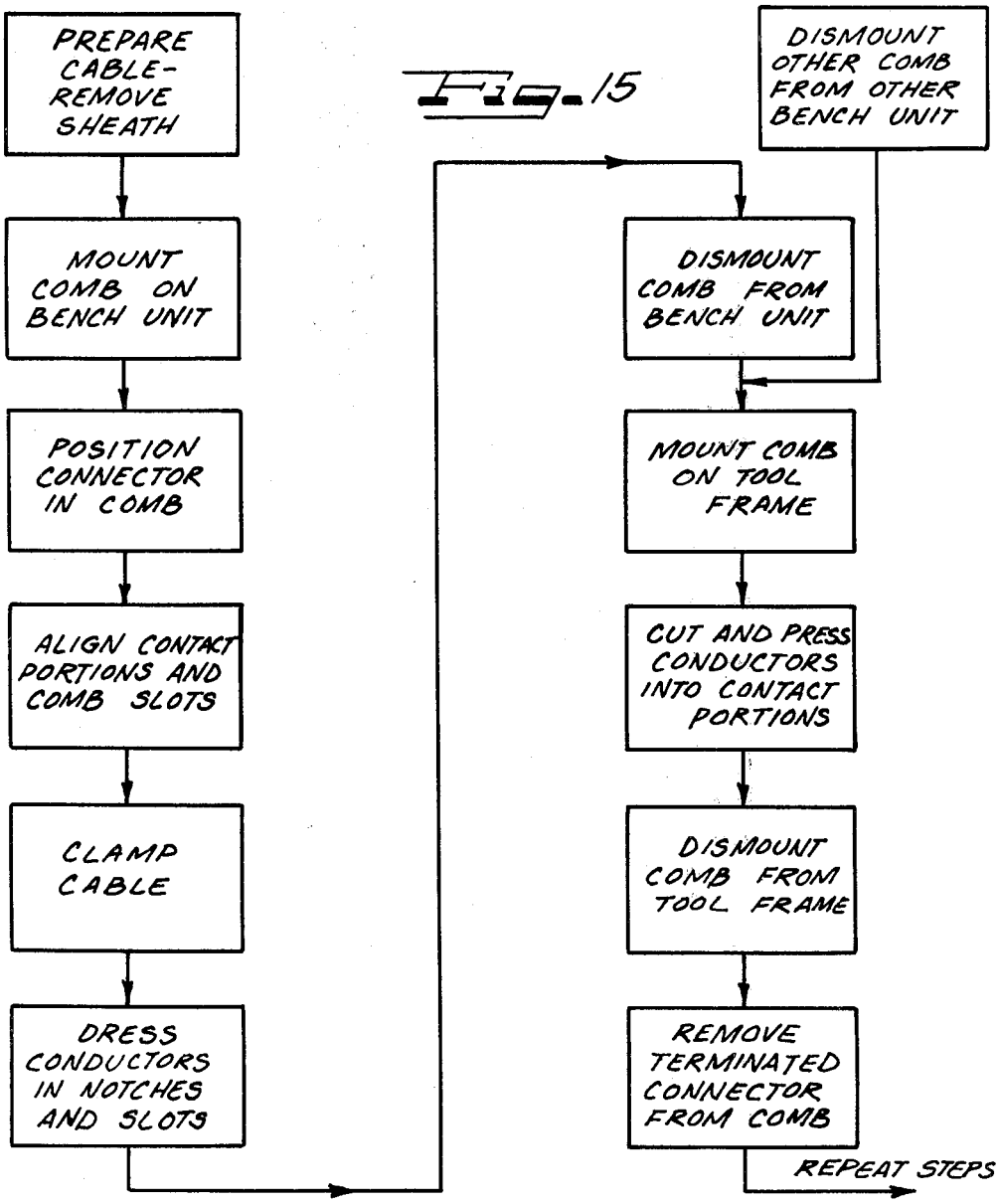

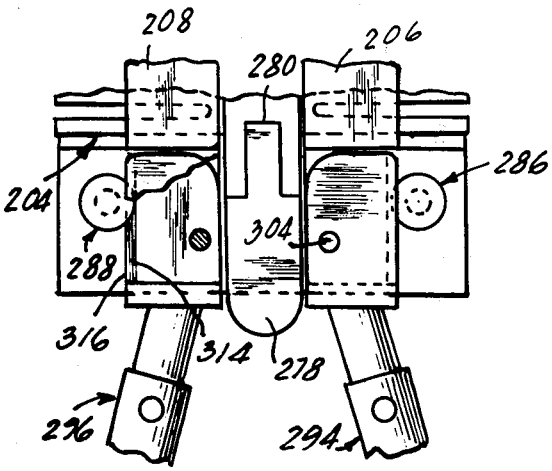
Fig. 12
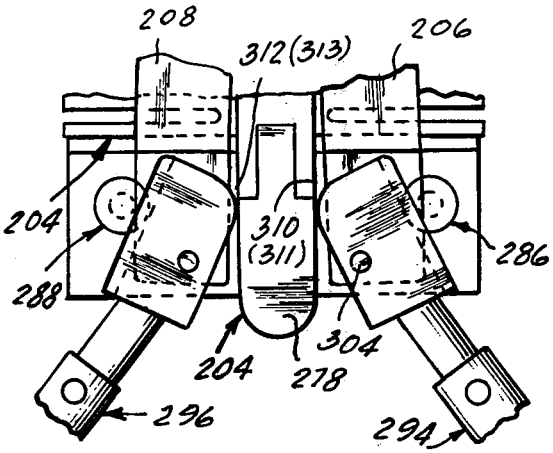
Fig. 14
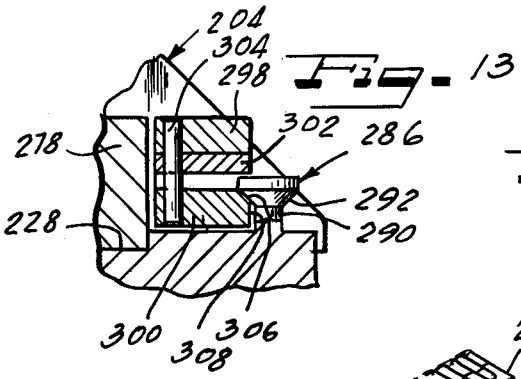
Fig. 13
Fig. 11
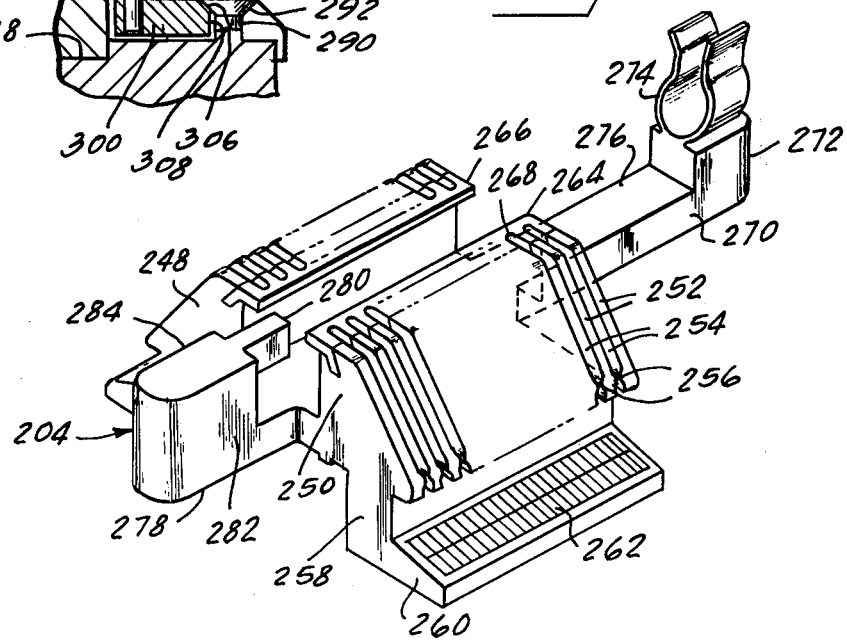

FIELD TERMINATION TOOL HAVING A REMOVABLE CONNECTOR MOUNTING MECHANISM AND AN INSERTION CONTROL MECHANISM

This is a divisional application of application Ser. No. 580,577, filed May 27, 1975, now U.S. Pat. No. 4,038,745.

CROSS REFERENCE TO RELATED APPLICATION

This application is related to an application entitled "Field Termination Tool Having Connector Reference Plane Apparatus and Hinged Insertion Arms", Ser. No. 432,484, filed Jan. 11, 1974, now U.S. Pat. No. 3,952,392.

BACKGROUND OF THE INVENTION

1. Field of the Invention

This invention relates to apparatus for terminating a plurality of insulated conductors in respective insulation-piercing contact portions of electrical connectors, and more particularly to such apparatus which comprises improved techniques for ensuring complete conductor insertion, and thus complete electrical integrity, of insulated conductors in insulation-piercing contacts of electrical conductors, and termination of a greater number of electrical connectors per unit of time that heretofore were possible.

2. Description of the Prior Art

A field termination tool of the same general type as that disclosed herein is disclosed in an application of John Peter Nijman and Terence Neil Patterson, Ser. No. 432,484, filed Jan. 11, 1974. The termination tool disclosed in this prior application generally includes a frame which carries a connector support and a pair of rotatable insertion arms which are rotated toward each other and carry multi-blade insertion tools for engaging and pressing insulated conductors into respective insulation-piercing contact portions of an electrical connector positioned on the connector support structure. Each of the insertion arms also carries a rotatably mounted handle which engages a fixed pin on the frame, acting as a fulcrum, for applying a force to the insertion arm to press the conductors into the respective insulation-piercing contact portions. The frame includes a pair of stop members for the insertion arms to generally define points which correspond to complete insertion and to prevent damage to the connector by preventing the application of excessive forces across the connector.

Inasmuch as the female connector has a narrower rear termination end than a corresponding male connector for a given line of connectors, for example the difference may be 0.80 inches, the termination apparatus of the prior application utilizes any one of a variety of mechanisms for controlling the depth of penetration of connectors of different widths. Also, inasmuch as there may be slight width variations from connector to connector of the same type in a given line of connectors, a floating connector support is utilized for accommodating connectors of different widths and for equalizing forces applied across a connector by oppositely directed insertion tools.

SUMMARY OF THE INVENTION

The primary object of the present invention is to provide an improved termination apparatus, particularly field termination apparatus, for terminating a plurality of free-ended insulated conductors in respective insulation-piercing contact portions of an electrical connector, including the provision of techniques and mechanisms for terminating greater number of connectors per unit of time than heretofore possible, while ensuring complete and proper termination of connectors, including connectors of different widths.

A more particular object of the invention is to provide termination apparatus which is responsive to a predetermined depth of penetration to provide a positive indication of complete termination.

Another object of the invention is to provide termination apparatus which is operable to provide a positive indication of completion of termination in response to the application of a predetermined torque to an insertion arm.

Another object of the invention is to provide termination apparatus which includes a connector support that is releasably engageable with the frame of the termination apparatus, and with a similarly constructed bench-mounted unit so that a connector may be mounted and the conductors dressed according to a wiring schedule at a point remote from the termination apparatus. An attendant object is to provide a plurality of plug-in type connector supports sized for different connectors to adapt the termination apparatus to a variety of connectors.

Yet another object of the invention is to provide techniques by which more connectors may be terminated per unit of time than heretofore possible.

Advantageously, an electrical connector which may be terminated by the apparatus and method of the invention includes an elongate electrically insulating rear portion a plurality of insulation-piercing contact portions supported on each side thereof. The contact portions may be disposed in individual channels defined by transversely extending protective barriers. A pair of longitudinally extending ribs are spaced apart to define an elongate slot therebetween and each ridge includes a plurality of notches which are aligned with respective insulation-piercing contact portions. If the contact portions are disposed within the aforementioned type of channels, each notch is in communication with a respective channel.

According to the invention, a termination tool includes a connector support which is constructed as a one-piece slotted comb structure having a base for connection to the frame of the insertion tool and for supporting the forward end of a connector. A pair of generally upstanding comb elements extend from the base and are spaced to receive an electrical connector therebetween. Each of the comb elements includes a plurality of teeth which define a plurality of conductor receiving slots therebetween. Preferably, the slots include a tapered or narrow portion to receive and hold the conductors. Advantageously, the comb structure may be a molded plastic structure, e.g. glass-filled thermoplastic, and include a pair of metal strips molded in respective upstanding comb elements adjacent and defining a cutting edge for each slot, a cutting edge being cooperable with a cutting edge of an insertion blade in the manner disclosed in the abovementioned application and as more specifically set forth hereinbelow.

The comb structure is adapted to be plugged onto the frame of the terminating apparatus and to be plugged onto a unit on the top of a work-bench. The work-bench mounted unit may be a simple plate, as will be understood from the detailed description below. In this manner more comb structures per tool may be employed and connector loading and wiring can be carried out at a separate station, so that the conductors may be associated with the respective insulation-piercing contacts of the connector with the connector mounted in the comb structure and the entire wired unit may be dismounted from the workbench and mounted on the termination apparatus for electrical connection of the conductors to the insulation-piercing contact portions. This method speeds overall production such that, for example, with the use of ten such comb structures, one connector can be terminated by a termination tool every fifteen seconds.

The one-piece comb structure can be sized according to particular dimensions of the connectors so that a termination tool is adapted to different connectors. In this manner, adjustments of the comb structure are eliminated.

In order to prevent damage to a connector due to the application of insertion forces across the connector, while at the same time ensuring good electrical and mechanical connections of the conductors and the insulation-piercing contacts, an insertion control mechanism is incorporated in the insertion tool and is operable to provide a positive indication of complete termination. In one embodiment the insertion control mechanism comprises a ratchet and pawl mechanism in which the ratchet is carried by one insertion arm and the pawl is carried by the other insertion arm. The pawl engages the ratchet in a substantially irreversible relationship and is only releasable therefrom upon movement of the arms toward each other to predetermined positions. In this manner, the arms are locked against movement which would separate the arms until such time that the arms have moved to positions at which the insertion tools have accomplished complete insertion of the insulated conductors. In another embodiment, each of the insertion arms is provided with a torque handle which is operable to generate a mechanical vibration which may be felt and or heard by an operator when the insertion arms have completed insertion and are offering a counter force or torque of a predetermined magnitude against the force applied to the arms for inserting the conductors.

BRIEF DESCRIPTION OF THE DRAWINGS

Other objects, features and advantages of the invention, together with its organization, construction and operation, will be best understood from the following detailed description taken in conjunction with the accompanying drawings, on which:

FIG. 2 is a partial sectional view of the plug-on comb structure illustrated in FIG. 1 and taken generally along the line II—II;

FIG. 3 is a sectional view taken substantially along the line III—III of FIG. 2 showing the cooperable releasable engagement mechanism for the plug-on comb structure;

FIG. 4 is a sectional view of another type of comb structure mounting, in particular a plug-in mounting;

FIG. 5 is an isometeric view of a work-bench mounted plug-on unit for use with the comb structure illustrated in FIGS. 1 and 2;

FIGS. 6, 7 and 8 are sectional views of a ratchet and pawl insertion control mechanism, constructed according to the invention, FIG. 6 showing the ratchet and pawl in a disengaged condition, FIG. 7 showing the ratchet and pawl in an engaged condition, and FIG. 8 showing the ratchet and pawl in a release condition;

FIG. 11 is a pictorial representation of another comb structure constructed according to the invention;

FIGS. 12, 13 and 14 are fragmentary views of another torque handle and a cooperable fulcrum structure constructed according to the invention; and FIG. 15 is a flow chart showing a typical sequence of conductor-connector termination in which electrical connectors are mounted in comb structures and preloaded with conductors at a bench mounted units and then, while in a mounted and loaded condition in the comb structures are transferred to the frame of the insertion apparatus for completion of termination.

DESCRIPTION OF THE PREFERRED EMBODIMENTS

Figures 1, 9:
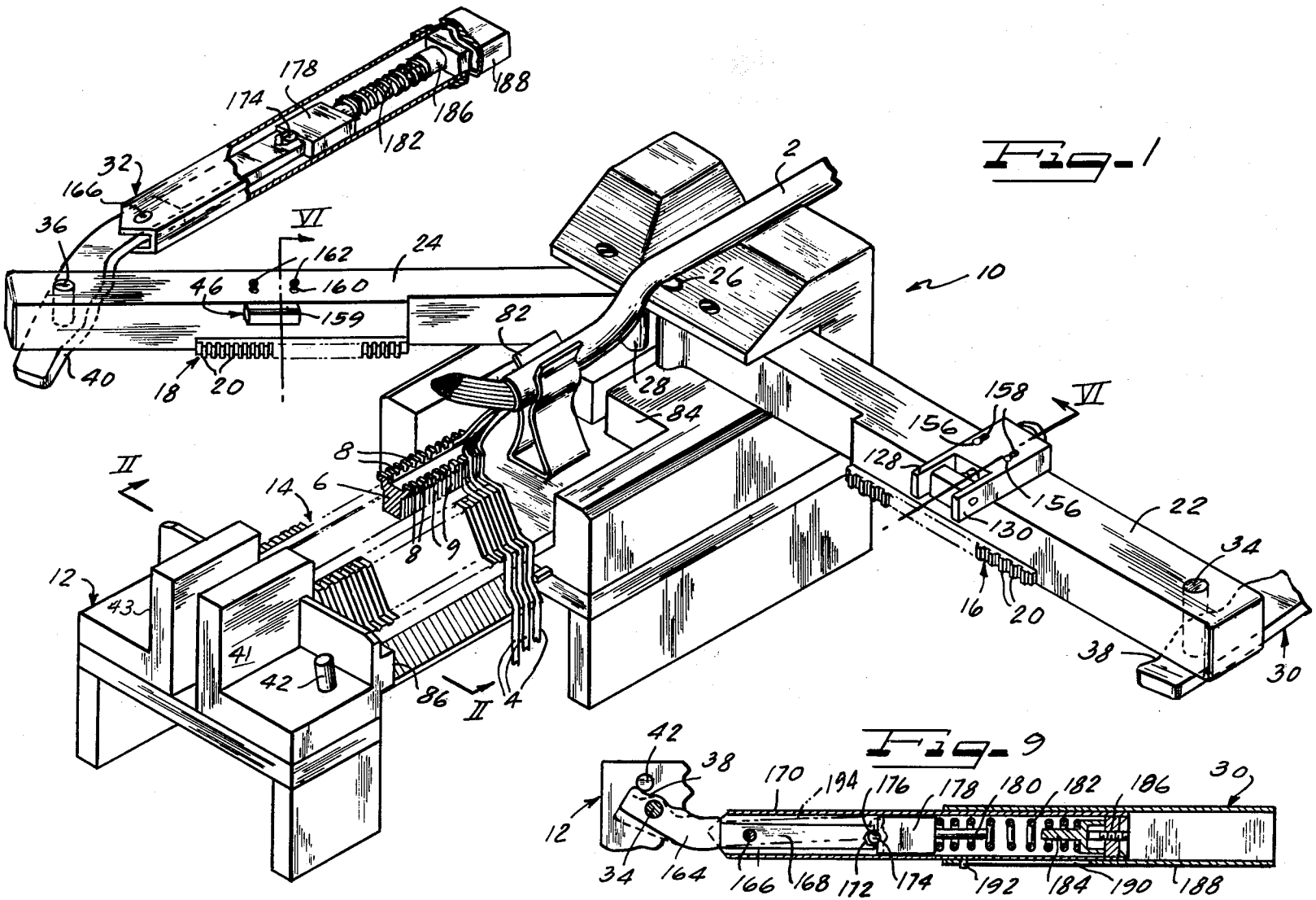
FIG. 1 is a pictorial representation of a terminating tool embodying the teachings of the present invention.
FIG. 9 is a longitudinal sectional view of a torque responsive insertion control mechanism constructed according to the invention.

Referring to FIG. 1, a terminating apparatus is generally illustrated at 10 as comprising a frame 12 which carries a connector support and conductor alignment mechanism 14 at a position where a supported connector 6 is in the path of travel of a pair of multi-blade insertion tools 18 each having a plurality of insertion members or insertion blades 20.

Advantageously, the connector 6 includes a plurality of transversely extending notches 8 as an aid to dressing respective insulated conductors 4 of a cable 2 which has had a portion of the outer protective sheath removed. Disposed immediately below each of the notches 8, between a plurality of channel forming barriers 9 is a respective insulation-piercing contact portion of an electrical contact of the connector. It is not necessary for the contact portion (not shown) to be disposed in such a channel and the contact portion may take a variety of forms which generally includes one or more oppositely facing insulation-piercing flanges forming a conductor receiving notch therebetween. As an insulated conductor is pressed into the conductor receiving notches of the contact portions, the flanges pierce the insulation and make electrical and mechanical contact with the conductor.

As is generally known, such electrical connectors come in a variety of sizes having different lengths, primarily determined by the number of contacts disposed along the connector, and in different widths, as in male and female connectors of the same line of connectors in which the male connector has a larger transverse rear width than the female connector. Consequently, care must be taken to ensure complete insertion to obtain good electrical connection, while at the same time avoiding damage to the connector upon the application of transverse insertion forces, as will be discussed in more detail.

Each of the multi-blade insertion tools 18 is carried by a respective insertion arm 22 or 24 which are mounted for rotation about respective axes at 26 and 28. In a manner that is generally known in the art, as the arms 22 and 24 are rotated toward each other, the insertion blades 20 engage respective ones of the insulated conductors 4 and press the same into respective insulation-piercing contact portions. Also, immediately prior to insertion, each of the conductors 4 may be severed by the lower edge of the respective insertion blade and a cutting member carried on the frame 12 adjacent the insulation-piercing contact portions.

In order to apply insertion forces, each of the insertion arms 22 and 24 is provided with a respective handle 30 and 32. The handle 30 is provided with a portion 38 and the handle 32 is provided with a portion 40 for engaging respective fulcrum pins 42 (only one shown) which are carried by the frame 12. Rotation of the arms 22 and 24 toward each other, engagement of the pins 42 by the handle portions 38 and 40, and further rotation of the handles 30 and 32 toward each other causes the force applied to the handles 30 and 32 to be converted into insertion forces at the insertion arms 22 and 24.

Each of the handles 30 and 32 are torque handles, and as will be discussed below, provide a positive indication that a sufficient insertion force has been provided to ensure complete termination without causing damage to a connector. Alternatively, the terminating apparatus 10 may be provided with a pawl mechanism 44 and a ratchet mechanism 46, carried by respective ones of the insertion arms 22 and 24 for ensuring that the insertion arms move toward each other a predetermined amount which corresponds to complete insertion, before the arms are permitted to move apart. This insertion control mechanism will also be discussed in greater detail below in connection with FIGS. 6, 7 and 8.

Turning now to FIGS. 2–5, the connector support and conductor alignment mechanism 14, alternative constructions thereof, and a method of increasing the number of connectors terminated per unit of time, will be discussed.

In FIG. 2, the connector support and conductor alignment mechanism 14 is illustrated as being mounted on a portion 48 of the frame 12. The portion 48 includes a pair of spaced rails 50 and 52 which are received in a recess 54 in the lower portion of a base 57 of a comb structure 56. The base 57 also includes a pair of lower surfaces 58 and 60 which rest on the frame portion 48. The base 57 carries a pair of generally upstanding comb elements 62 and 64 which extend above an upper surface 59 and which include respective portions 66 and 68 which extend substantially parallel to the surface 59. An electrical connector is slid into the comb structure 56 (from the rear as viewed in FIG. 2) so that the forward end thereof rests on the surface 59 and the rear end thereof extends upwardly between the comb element portions 66 and 68.

The comb structure, as is evident from the drawing, may advantageously be a one-piece structure, and may be adapted by a spring element or the like to establish a reference datum plane as in the aforementioned copending application, wherein the comb element portion 66 and 68 engage a peripheral flange of a connector.

Each of the upstanding comb elements 62 and 64 includes a plurality of spaced comb teeth 70 which define a plurality of conductor receiving slots 72 which are spaced in accordance with the spacing of the insulation-piercing contact portions of a corresponding electrical connector. Therefore, in loading a connector into the comb structure, the insulation-piercing contact portions are aligned with the slots 72. As indicated on the drawing the slots 72 may be tapered to form conductor holding portions 73 to receive and hold the conductors.

Each of the upstanding comb elements 62 and 64 includes a metal strip 74 shaped to have a generally downwardly extending portion 76 and a generally horizontally extending portion 78. The outer edge of each of the metal strips 74 is a sharp edge and defines a cutting edge 75 at each slot adjacent the respective insulation-piercing contact portion. The cutting edge 75 is cooperable with the lower cutting edge of a respective insertion blade 20 to sever a conductor immediately prior to insertion.

The base 57 includes an extended portion 80 which mounts a cable clamp 82. The base 57 may also carry, as schematically indicated, a waste spring 79 for holding the waste ends of the insulated conductors after the same have been dressed into the notches 8 and guided into alignment with the insulation-piercing contact portions by disposition in the guiding slots 72, in addition to or as an alternative to the tapered portions 73 of the slots 72.

As illustrated in FIGS. 1 and 2, the frame includes, in the area of the connector support and conductor alignment mechanism, a rear wall 84 and a forward wall 86 which serve to position the comb structure 56 longitudinally with respect to the frame 12.

The comb structure 56 and the frame 12, at the portion 48, are releasably engageable with each other as indicated at 88 in FIG. 2 and as shown in detail in FIG. 3. In FIG. 3 the reference character 88 identifies the releasable engagement mechanism and the same is illustrated as comprising a detent 90 in the side wall of the recess 54 which receives a spring loaded ball 92. The ball 92 is retained in a cylindrical can-tight device 96 having an inwardly directed flange 94 which defines an opening that is smaller than the diameter of the ball 92. A spring 98 bears against the rear wall of the can 96 and against the ball 92 to urge the ball 92 outwardly. The can 96 is mounted in a bore 97 in the rail 50. A plurality of such ball-detent structures may be provided so that the comb structure 56 may be plugged onto the frame portion 48.

Other similar releasable engagement structures may be utilized. For example, FIG. 4 illustrates a releasable engagement mechanism 100 in which the comb base 57′ includes a shaped plug which depends from the upper surface of the recess 54. The frame portion, here the portion 48′, includes a recess 106 which mounts a clamp 108 similar to the cable clamp 82 of FIG. 2. The clamp 108 includes a pair of spaced shaped fingers 110 and 112 which define a narrow opening 114 and a larger opening 116 which is complementary to an enlarged portion 104 of the shaped plug 102. With this arrangement, the comb base 57′ is plugged into the spring clamp 108 of the frame. Of course, many other variations of this basic principle may be utilized.

In FIG. 5, a portion of the upper surface 12′ (corresponding to the frame 12) of a work-bench is illustrated as having a plate 48″ secured thereto and including a plurality of spring loaded ball mechanisms 88′. The plate 48″, and its spring loaded ball structures 88′, are received in the recess 54 (FIG. 2) of the comb structure as the comb structure is plugged onto the work-bench. A similar arrangement complementary to the structure illustrated in FIG. 4 for the frame portion 48′ may also be provided. The important feature here, however, is that a comb structure may be placed in releasable engagement with a work-bench so that an electrical connector may be loaded therein and the conductors dressed in the connector, according to a predetermined wiring schedule, while another such structure is mounted on an undergoing termination by the terminating apparatus 10. The wired unit may be dismounted from the work-bench and mounted on the frame of the terminating apparatus, and then dismounted and unloaded after undergoing the termination process. The utilization of a plurality of such structures greatly increases the speed of termination when a number of connectors and conductors are to be terminated.

The flow chart of FIG. 15 sets forth a complete process for terminating a plurality of insulated conductors in respective insulation-piercing contact portions of an electrical connector according to the invention. Referring to FIG. 15, a typical procedure for terminating electrical conductors and connectors in accordance with the invention shows that a cable is first prepared by removing a portion of its outer sheath to expose the individual insulated conductors. Next, the comb structure (57) is mounted on the complementary bench unit (48''), a connector is slid into the comb structure from the rear and the insulation-piercing contact portions are aligned with the comb slots. The cable is then clamped in the cable clamp (82) so that the individual connectors are available for dressing into the connector and comb structure. It is apparent that a connector may be positioned and its contacts aligned with the comb slots before the same is mounted on the bench unit. It is also apparent that the sheath may be removed from the cable just prior to clamping the cable, or even after clamping the cable in the cable clamp.

After the connector has been properly positioned and aligned in the comb structure and the cable has been clamped in the cable clamp, the individual conductors are dressed into and held by the notches 8 and guided across the cutting edges 75 and down into and to be held by the tapered portions 73 of the slots 72 (FIGS. 1 and 2). A conductor schedule, based on color coding or the like, may be positioned on the work bench adjacent the respective comb slots to aid in dressing. Also, if waste springs are employed, the waste ends of the conductors may be pushed between the pitches of the waste springs.

After completion of the dressing operation, the comb structure carrying the dressed connector is dismounted from the bench unit and mounted on the frame of the terminating apparatus. As indicated in FIG. 15, other comb structures may be undergoing loading operations and enter the termination process at this point. The insertion tools are carried into position by rotation of the insertion arms toward each other and insertion is accomplished (including conductor severing if necessary) in the manner described in the aforementioned application in which the handles 30 and 32 are moved toward each other, engage the respective fulcrum pins 42 and apply insertion forces to the insertion arms.

After completion of insertion, the comb structure carrying the terminated connector is removed from the frame of the terminating apparatus, the cable is unclamped and the terminating connector is removed from the comb structure by sliding the same out the rear end of the comb structure.

If the individual conductors have been severed during the terminating operation, the waste ends are removed from the waste springs and the above steps are repeated for another connector.

In the foregoing discussion, reference has been made to sliding the connector into and out of the comb structure from the rear end. This assumes that the comb structure has a somewhat closed forward end which may be constituted by a stop wall (partially shown in FIG. 2), or an adjustable stop, such as a screw or the like, which aids in aligning the insulation-piercing contact portions with the comb slots 72.

The comb structure may be die cast or machined from solid metal, or, preferably, it may be molded from plastic material, such as a glass filled thermoplastic material, with the two metal strips 75 molded therein as cutting members.

The one-piece comb structure could also be constituted by a plurality of individual members which are secured together, as by screws or the like, to form a unitary structure.

Terminating apparatus according to the invention also includes insertion control means for ensuring completion of insertion and avoiding damage to the electrical connector. The insertion control means may take a variety of forms and is illustrated herein as comprising either a ratchet and pawl mechanism or a torque responsive mechanism, both of which are illustrated in FIG. 1 for purpose of convenience, although it is unlikely that both mechanisms will be used at the same time.

Referring to FIGS. 1, 6, 7 and 8, a ratchet and pawl type insertion control mechanism is illustrated as comprising a pawl mechanism 44 mounted on the insertion arm 22 and a ratchet mechanism 46 mounted on the insertion arm 24. In FIGS. 6–8, reference characters 22' and 24' have also been employed to indicate that a single movable arm may be utilized on one side of a connector, for terminating on one side, while the opposite cooperable mechanism may be connected to a fixed structure, such as the frame. Therefore, unprimed reference characters indicate movable members while primed reference characters indicate fixed structures, it only being necessary to relate one cooperable structure with the other in a relative sense as the structures are engaging and disengaging at positions which constitute engagement of the insertion blades with the insulated conductors.

Referring to FIG. 6, the ratchet 46 is illustrated as comprising a plurality of ratchet teeth 118 each having a forward surface 120 and a rear surface 122, as referenced to the relative oncoming pawl mechanism 44. A recess 124 is defined at a location immediately to the rear of the ratchet teeth 118.

The pawl mechanism 44 includes a block 126 having a pair of forwardly extending and spaced projections 128 and 130 which pivotally mount a pawl 132 therebetween on a pivot pin 134. The pawl 132 includes a pawl tooth 136 which extends downwardly from a lower surface 138 of the pawl. The block 126 includes a bore 140 having a threaded portion 142 with a threaded cap 144 closing one end thereof. A threaded adjustment plug 146 is provided in the threaded portion 142 of the bore 140 to engage one end of the spring 148. The spring 148 has another end which bears against a bias pin 150 which projects from the bore 140. The bias pin 150 has a shaped surface 152, here a conical surface, with an end 154 which engages the pawl 132.

As seen in FIG. 7, as the pawl 132 engages the ratchet teeth 118, the pawl is pivoted in a counterclockwise direction, as viewed in the drawing, so that the lower surface of the pawl tooth 136 lies generally parallel to the rear surface of a ratchet tooth as the pawl passes the apex of that tooth. If the relative movement of the pawl mechanism is in the direction of the arrow A, the pawl steps across the ratchet from one end to the other. If, however, relative movement in the opposite direction is attempted, as indicated by the broken arrow B, the pawl tooth 136 engages the rear surface 122 of the pawl tooth and prevents disengagement of the ratchet pawl mechanisms.

Referring to FIG. 8, when the pawl mechanism has moved relative the ratchet mechanism to an extent where the pawl tooth 136 enters the recess 124, the bias pin 150 causes a clockwise rotation of the pawl to realign the same in a generally vertical relationship with the pawl tooth 136 directed downwardly. It is apparent that in this condition, a disengagement movement of the pawl mechanism in the direction of the arrow C will permit the pawl to pivot clockwise and move step-by-step along the ratchet teeth until the mechanisms have disengaged.

The position of the recess 124 corresponds to a position of the insertion tools at which termination is completed. Therefore, an operator may apply insertion forces to the insertion arms until such time as he observes the vertical orientation of the pawl signaling that the pawl has entered the recess. In order to prevent the application of excessive force across a connector the handles may be constructed to stop against each other or against a pair of stop walls 41 and 43 (FIG. 1).

Referring to FIG. 1, the ratchet mechanism may be rendered adjustable for different size connectors, for example male-female width differences, by the provision of a pair of figure-8 slots 156 having respective screws 158 therein for adjusting the position of the pawl with respect to the transverse width of a connector. Similarly, the ratchet mechanism 46 may be mounted in an adjustable block, or the mechanism may be inserted in a ratchet slot 159 and provided with a pair of threaded bores to receive threaded screws 162 which extend through respective elongate slots 160 in the insertion arm.

The male-female adjustment may be eliminated and a positive indication of complete termination may be provided through the utilization of torque responsive handles, as illustrated in FIGS. 1 and 9. Each of the handles 30 and 32 is constructed as a torque handle which includes a torque lever 164 having a pivot pin 166 connecting the lever to a hollow handle 170. The torque lever 164 includes a lever portion 168 having an end with a recess 172 which receives a ball 174 therein. The ball 174 is also received in a detent 176 of a block 178. The block 178 is urged toward the ball 174 by a spring 182 which surrounds a projection 180 of the block 178 and a projection 184 of an adjustable end mechanism 186.

A handle extension 188 surrounds the hollow handle 170 and includes a slot 190 having a pin 192 therein which is secured to the hollow handle 170.

As the portion 38 of the torque lever 164 engages the fulcrum pin 42 and applies an insertion force to the corresponding insertion arm, the torque lever 164 develops a moment about the pin 166 in the counterclockwise direction as viewed in FIG. 9. With the application of an insertion force, the moment about the pivot pin 166 increases and in turn, increases the force applied by the ball 174 to depress the spring 182. As the force increases to a level at which the spring begins to compress and the ball 174 moves counterclockwise out of the detent 176, the torque lever 164 moves rapidly toward the position 194 at which its inner end, or the ball 174, depending on the particular dimensions and relationships, strikes the inner wall of the hollow handle 170. The impact generates a mechanical vibration which is felt by an operator and an audible click which is heard by the operator, each of which is a positive indication that termination is complete.

In using the torque handles, the multi-blade insertion tools are set at a fixed distance to ensure reliable termination of both male and female connectors and the torque handles are pre-set for a terminating force of 45 pounds, for example. The handle extension 188 is telescopic to the extent defined by the slot 190 and the pin 192 and serves to provide an additional mechanical advantage so that the terminating apparatus can easily be operated by female operators.

The torque handles may be constructed by modifying a torque box wrench which is available from the Torvaal Company, Chagrin Falls, Ohio and modified by first shortening the main tool handle and replacing the steel ball thereof with a smaller ball, for example 3/16" diameter. A telescopic handle is added to increase leverage and the front handle tip, formed as a box wrench, is replaced by a new tip (torque lever 164) suitable for use with the terminating apparatus.

In utilizing torque handles, as described herein, a predetermined pressure may be applied to the insulated conductors, this pressure being pre-set to a level required to obtain reliable termination of even the heaviest wire types (up to AWG 22) ordinarily terminated in these types of electrical connectors.

A preferred embodiment of the invention, utilizing torque handles and a preferred form of a one-piece comb structure is illustrated in FIGS. 10–14 in which a terminating apparatus 200 is illustrated as comprising a frame 202 which supports a connector support and conductor alignment mechanism 204 in a releasable engagement relationship.

A pair of insertion arms 206 and 208 carry respective multi-blade insertion tools 210 and 212 having respective pluralities of insertion blades 214 and 216 for engaging and pressing insulated conductors into insulation-piercing contact portions carried on a connector (not shown) mounted on the connector support and conductor alignment mechanism 204 in a manner similar to that illustrated in FIG. 1. The insertion arms 206 and 208 include laterally extending recessed ends 220 and 222, respectively, which are rotatably mounted to the frame 202 by means of a pin 218. Each of the ends 220 and 222 are recessed by an amount approximately half the thickness of its arm so that the arms rotate in a common plane.

A frame 202 includes a slot 224 having an arcuate end 226 and a slot 228 which is generally aligned with the slot 224 and of the same depth and transverse dimension. The slots 224 and 228 communicate with a recess 238 which is generally defined by a pair of rear walls 230, 232 and a pair of forward walls 234, 236. The recess 238 and the slots 224 and 228 generally define the outline of and are dimensioned to receive the connector support and conductor alignment mechanism. The recess 238 includes an upper surface 240 for supporting the connector support and conductor alignment mechanism 204 and a pair of side surfaces 242 (only one shown) each of which includes at least one releasable engagement mechanism 244 which may advantageously be in the form of a spring loaded ball, such as the releasable engagement mechanism 88 illustrated in FIG. 3.

Figure 10:
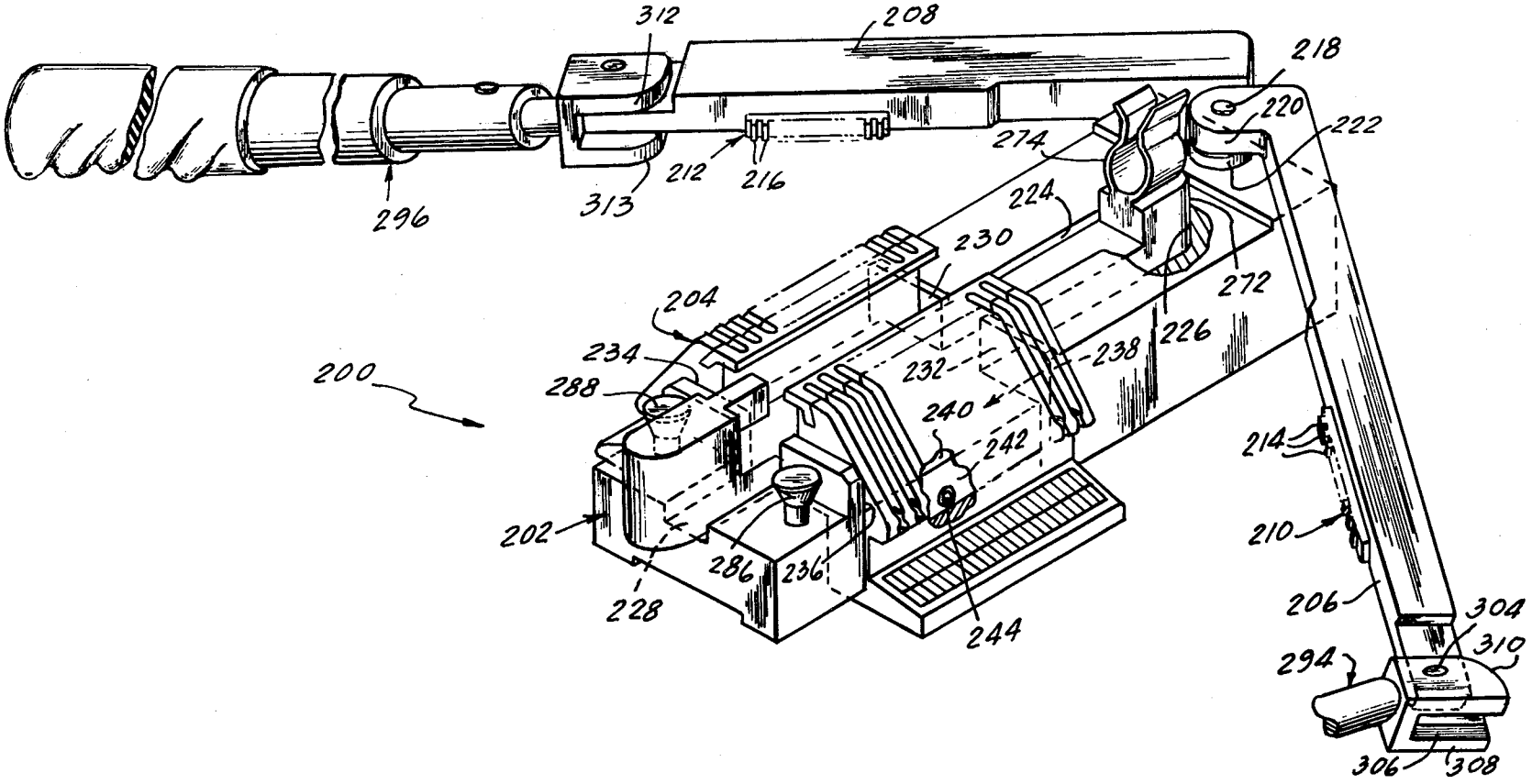
FIG. 10 is a pictorial representation of another terminating tool embodying the teachings of the present invention.

Referring to FIGS. 10 and 11 in particular, the connector support and conductor alignment mechanism 204 is illustrated as including a comb structure having a base 246 and a pair of comb elements 248 and 250. Each of the comb elements 248 and 250 comprises a plurality of spaced comb teeth 252 which define a plurality of comb slots 254 therebetween which are spaced according to the spacing of the contacts of a connector which is to be terminated. Each of the comb slots 254 includes a restricted or narrow portion 256 which receives and holds a respective conductor.

Associated with each of the comb elements is a downwardly extending member 258 and a laterally extending member 260 which carries a wiring schedule indicia 262 in the form of color coding or the like.

As in the connector support and conductor alignment mechanism 14 illustrated in FIGS. 1 and 2, the connector support and conductor alignment mechanism 204 may be molded from a plastic material, such as glass-filled thermoplastic material, and have a pair of generally L-shaped metal strips 264 and 266 molded therein for providing cutting edges 268 at the rear upper portions of the slots adjacent the respective insulation-piercing contact portions of a connector.

The base 246 comprises a rear base extension 270 having an arcuate end 272 which is complementary to the arcuate end 226 of the slot 224. The rear base extension 270 includes an integral molded cable clamp 274 for receiving and holding a multi conductor cable therein. The base 246 also comprises a forward base extension 278 which carries an integral stop means for a connector as the same is slid into contact therewith from the rear, and a pair of camming surfaces 282 and 284 which aid in disengaging the insertion blades 214 and 216 from a connector, as will best be understood from the description below in connection with FIG. 14.

Referring to FIGS. 10, 12 and 13, the terminating apparatus 200 is illustrated as comprising a pair of fulcrum means 286, 288 which project upwardly from the forward end of the frame 202 on respective sides of the slot 228. The fulcrum means 286 and 288 are similar to the fulcrum pin 42 illustrated in FIG. 1 and engage respective torque arms 294 and 296. The torque arm 294 comprises a pair of spaced end members 298 and 300 which receive an end portion 302 of the insertion arm 206 therebetween and which are rotatably connected to the end portion 302 by means of a pivot pin 304. The end member 300 includes an oblique cam surface 306 which engages a conical portion 292 of the fulcrum means 286 so as to impart a downward force on the insertion arm 206 to prevent separation between the lower edges (cutting edges) of the insertion blades 214 and the cutting edges 268 of the slots 254 and ensure a complete and clean separation of the conductors during severing. The end member 300 also includes a camming surface 308 for rotary camming of the torque arm 206 about the fulcrum means 286. As shown in FIG. 12, the end of the torque arm 296 is similarly constructed and includes a pair of cam surfaces 314 and 316 for engaging the fulcrum means 288.

It should be noted that as the rotatably connected ends of the torque arms 294 and 296 enter the areas between the surfaces 282, 284 and the fulcrum means 286, 288, the do not strike surfaces 282 and 284 in that clearance is provided through the provision of arcuate surfaces 310, 311 at the end of the torque arm 294 and 312, 313 at the end of the torque arm 296. In addition to providing clearance for the ends of the torque arms, the arcuate surfaces 310–313 function as camming surfaces in cooperation with the camming surfaces 282 and 284 to aid in disengaging the insertion blades 214, 216 from the electrical connector. This feature is of particular advantage when terminating in electrical connectors which have the insulation-piercing contact portions disposed in channels formed by barriers therebetween in that the barriers tend to grip the insertion blades and hinder withdrawal thereof from a connector. The insertion arms 206 and 208 and the torque arms 294 and 296 are illustrated in FIGS. 12 and 14 for a comparison thereof between positions of complete insertion and positions during disengagement. FIG. 14 illustrates that as the torque arms 294 and 296 are rotated away from each other, the arcuate camming surfaces 310–312 engage the camming surfaces 282, 284 to force the insertion arms 206 and 208 away from each other. Inasmuch as the penetration of the insertion blades is small and the frictional contact between the insertion blades and barriers or the like is of a short distance, the slight rotational movement provided by the leverage of the arcuate camming surfaces 310–313 against the camming surfaces 282, 284 is sufficient to overcome the frictional forces and effect disengagement of the insertion blades from a connector.

It is readily apparent that the terminating apparatus 200 illustrated in FIGS. 10–14 may be operated in accordance with the method set forth in connection with FIG. 15 so that a detailed discussion of the operation of the terminating apparatus 200 would be a reiteration of the operation of the terminating apparatus 10; therefore, an operational sequence for the terminating apparatus 200 will not be provided herein.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. Conductor termination apparatus having releasably engageable connector support and conductor alignment apparatus comprising:

a frame on said conductor termination apparatus;

a base including a portion for receiving an electrical connector thereon;

a pair of comb elements extending from said base to receive a connector therebetween, each of said comb elements including comb teeth defining conductor receiving slots therebetween which open away from the connector and which are spaced corresponding to the contact spacing of the connector; and releasable engagement means for releasably mounting said base on said frame, said releasable engagement means including at least one first part carried on said frame, and at least one second part carried on said base, at least one of said parts including spring means for releasably engaging the other of said parts.

2. Apparatus according to claim 1, comprising:

a pair of members extending generally laterally from said base adjacent respective comb elements, each of said members bearing indicia defining a wiring schedule relating individual conductors to respective comb slots.

3. Apparatus according to claim 1, the connector having a front end and a shoulder on each side thereof spaced from the front end, the front end received on said portion of said base, and wherein:

each of said comb elements includes a portion which extends generally parallel to said base to engage the shoulders of the connector, the connector being received by sliding the same onto said base from a position beyond one end of said comb elements.

4. The support and alignment apparatus of claim 1, wherein said spring means includes at least one spring-loaded ball.

5. The support and alignment apparatus of claim 4, wherein said spring-loaded ball is carried by said frame.

6. The support and alignment apparatus of claim 1, wherein said first part comprises a pair of spaced, shaped spring arms and said second part comprises a complementary shaped projection to be received between and releasably gripped by said spring arms.

7. Conductor termination apparatus having releasably engageable connector support and conductor alignment apparatus comprising:

a frame on said conductor termination apparatus;

a base including a portion for receiving an electrical connector thereon;

a pair of comb elements extending from said base to receive a connector therebetween, each of said comb elements including comb teeth shaped to define conductor receiving slots therebetween which are spaced corresponding to the contact spacing of the connector and which include narrow portions for receiving and holding the respective conductors; and releasable engagement means for releasably mounting said base on said frame, said releasable engagement means including at least one first part carried on said frame, and at least one second part carried on said base, at least one of said parts including spring means for releasably engaging the other of said parts.

8. Support and alignment apparatus for releasable engagement with a frame of conductor termination apparatus, comprising:

a base including a portion for receiving an electrical connector thereon;

a pair of comb elements extending from said base to receive a connector therebetween, each of said comb elements including comb teeth defining conductor receiving slots therebetween which open away from the connector and which are spaced corresponding to the contact spacing of the connector, and a pair of metal strips defining cutting edges at each of said slots opposite the openings thereof, said base and said comb elements combined as a one-piece molded plastic structure with said metal strips molded in said structure; and releasable engagement means for releasably mounting said base on the frame of the conductor termination apparatus, said releasable engagement means including at least one first part carried on the frame, and at least one second part carried on said base, at least one of said parts including spring means for releasably engaging the other of said parts.

9. Support and alignment apparatus for releasable engagement with a frame of conductor termination apparatus, comprising:

a base including a portion for receiving an electrical connector thereon;

a pair of comb elements extending from said base to receive a connector therebetween, each of said comb elements including comb teeth defining conductor receiving slots therebetween which open away from the connector and which are spaced corresponding to the contact spacing of the connector, said base and said comb elements being a one-piece molded structure; and releasable engagement means for releasably mounting said base on the frame of the conductor termination apparatus, said releasable engagement means including at least one first part carried on the frame, and at least one second part carried on said base, at least one of said parts including spring means for releasably engaging the other of said parts.

10. Apparatus according to claim 9, wherein said one-piece molded structure comprises an integral molded cable clamp extending from said base.

11. Apparatus according to claim 9, wherein said one-piece molded structure comprises an integral molded connector stop extending from said base to a point along a line between said comb elements.

* * * * *